US006276779B1

(12) United States Patent
Smith

(10) Patent No.: US 6,276,779 B1
(45) Date of Patent: Aug. 21, 2001

(54) ACOUSTIC FLUID EMISSION HEAD AND METHOD OF FORMING SAME

(75) Inventor: Donald L. Smith, Bolinas, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/448,801

(22) Filed: Nov. 24, 1999

(51) Int. Cl.[7] ..... B41J 2/135
(52) U.S. Cl. ..... 347/46
(58) Field of Search ..... 347/45, 46, 47, 347/54, 68, 85, 87, 89

(56) References Cited

U.S. PATENT DOCUMENTS 5,686,945 * 11/1997 Quate et al. ..... 347/46
5,736,998 * 4/1998 Caren et al. ..... 347/45
5,821,958 * 10/1998 Lim ..... 347/46
6,007,183 * 12/1999 Horine ..... 347/46

* cited by examiner

*Primary Examiner*—N. Le
*Assistant Examiner*—Anh T. N. Vo
(74) *Attorney, Agent, or Firm*—Fay, Sharpe, Fagan, Minnich & McKee, LLP

(57) ABSTRACT

This invention relates to an improved acoustic fluid emission head, e.g. an acoustic ink printhead, and a method of forming or assembling same. More particularly, the invention is directed to an acoustic ink printhead that advantageously incorporates elastomer gaskets to replace all epoxy joints in the printhead and a corrugated spacer to provide focal gap control in the printhead. A related method for manufacturing the printhead includes folding and spot welding the aperture plate of the printhead to maintain the elastomer gaskets in place and, consequently, control the focal gap.

20 Claims, 4 Drawing Sheets

ACOUSTIC FLUID EMISSION HEAD AND METHOD OF FORMING SAME

BACKGROUND OF THE INVENTION

This invention relates to an improved acoustic fluid emission head, e.g. an acoustic ink printhead, and a method of forming or assembling same. More particularly, the invention is directed to an acoustic ink printhead that advantageously incorporates elastomer gaskets to replace epoxy joints in the printhead and a corrugated spacer to provide focal gap control in the printhead. A related method for forming the printhead includes folding and spot-welding the aperture plate of the printhead to maintain the elastomer gaskets in place and, consequently, control the focal gap.

While the invention is particularly directed to the art of acoustic ink printing, and will be thus described with specific reference thereto, it will be appreciated that the invention may have usefulness in other fields and applications. For example, the invention may be used in any application where acoustic emitters are used.

By way of background, acoustic ink printing involves the emission of a droplet of ink from a pool of ink toward a print medium. Sound waves are generated and focussed toward the surface of the ink pool to emit the droplet therefrom. While acoustic ink printing elements may take various forms, such elements typically include a piezoelectric transducer, a lens, a cover plate having apertures formed therein to allow emission of the ink, and corresponding wiring. It is to be appreciated that approximately one thousand (1,000) or more of these elements may be disposed on a single printhead. It should also be appreciated that other fluids may be emitted such as molten metal, etc. rather than ink.

More particularly, as shown in FIG. 1, a single acoustic element 10 includes a glass layer 12 having an electrode layer 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown at 20 and cables 22 to a radio frequency (RF) power source 24 which generates power that is transferred to the electrodes 14 and 18. On a side opposite the electrode layer 14, a lens 26, preferably a concentric Fresnel lens, is formed. Spaced from the lens 26 is a liquid level control plate 28, having an aperture 30 formed therein. Ink, or fluid, 32 is retained between the liquid level control plate 28 and the glass layer 12, and the aperture 30 is aligned with the lens 26 to facilitate emission of a droplet 34 from surface 36. The surface 36 is, of course, exposed by the aperture 30.

The lens 26, the electrode layer 14, the piezoelectric layer 16, and the electrode 18 are formed on the glass layer 12 through known photolithographic techniques. The liquid level control plate 28 is subsequently positioned to be spaced from the glass layer 12 to establish a focal gap. The ink 32 is fed into the space between the plate 28 and the glass layer 12, e.g. the focal gap space, from an ink supply (not shown).

Acoustic ink printheads of the type incorporating emitting elements as described above typically have components that are bonded together with epoxy material. Epoxy bonded heads have the disadvantages of 1) experiencing epoxy delamination by the ink and 2) requiring increased manufacturing time resulting from the excessive cure time inherent in use of epoxy materials. Moreover, many types of epoxy materials are simply not compatible with the types of ink used in acoustic ink printing. Another disadvantage of the heretofore known types of acoustic emission heads is that, in such heads, it is difficult to maintain a uniform focal gap, i.e. the gap between the control plate 28 and the glass layer 12 shown in FIG. 1, across the entire emitting surface of the head. Controlling the focal gap is important for purposes of precision in emitting fluid.

It would, therefore, be advantageous to provide a head that is assembled without the use of epoxy. Such a head would be easier to assemble and would avoid the problems associated with the lack of compatibility of certain epoxy materials and the ink. It would also be advantageous to provide a head with improved focal gap control.

The present invention contemplates a new guleless acoustic ink printhead and a method of assembling the printhead that resolves the above-referenced difficulties and others.

SUMMARY OF THE INVENTION

A method and apparatus relating to an improved acoustic fluid emitting head, e.g. an acoustic ink printhead, are provided.

In one aspect of the invention, the apparatus comprises a glass substrate having lenses with emitters positioned thereon, a first frame positioned to support the glass substrate—the first frame having a flange extending therefrom, a first plate having a first portion with apertures defined therein, a second portion and a third portion—the apertures being positioned in alignment with the lenses of the glass substrate and separated from the lenses by a predetermined distance to establish a focal gap, a second frame positioned to support the first plate, a first sealing member disposed between the first plate and the second frame, a second sealing member disposed between the flange of the first frame and the second frame, a second plate positioned between the second portion of the first plate and the glass substrate—the second plate having corrugations defined therein, wherein the third portion of the first plate is disposed at an angle relative to the first and second portions and is connected to the second frame, and further wherein the flange of the first frame is connected to the second frame such that the glass substrate is maintained in a position between the first frame and the first plate.

In another aspect of the invention, the apparatus comprises an elastomer cushion and seal member positioned between the first frame and the glass substrate.

In another aspect of the invention, the flange is a deformable spring plate.

In another aspect of the invention, the apparatus comprises a fold between the second and third portions of the first plate.

In another aspect of the invention, the first sealing member is an elastomer gasket.

In another aspect of the invention, the second sealing member is an elastomer gasket.

In another aspect of the invention, the second frame includes a recess into which the elastomer gasket is disposed.

In another aspect of the invention, the second frame includes a recess into which the elastomer gasket is disposed.

In another aspect of the invention, the corrugations of the second plate are disposed to facilitate fluid flow.

In another aspect of the invention, the apparatus comprises a spot weld to connect the third portion of the first plate to the second frame.

In another aspect of the invention, the apparatus comprises a spot weld to connect the flange of the first frame to the second frame.

In another aspect of the invention, the apparatus comprises a fluid path extending between the first and second frames and through the corrugations of the second plate and the focal gap.

In another aspect of the invention, the apparatus comprises a tab positioned to align the glass substrate on the first frame.

In another aspect of the invention, the method comprises steps of folding the first plate such that a fold demarcates the second portion from the third portion, positioning the first sealing member in the first recess of the second frame, connecting the first plate to the second frame such that the first sealing member is compressed between the third portion of the first plate and the second frame, positioning the glass substrate to be supported by the first frame, maintaining the position of the glass substrate relative to the first frame with tabs extending from the first frame, positioning the second sealing member in the second recess of the second frame, positioning the second plate on a second portion of the glass substrate, positioning the first plate over the glass substrate and the second plate such that the first portion of the first plate is in alignment with the first portion of the glass substrate such that a focal gap is established between the first portion of the first plate and the first portion of the glass substrate and such that the second plate is positioned between the second portion of the first plate and the second portion of the glass substrate and connecting the flange of the first frame to the second frame such that the second sealing member is compressed between the flange of the first frame and the second frame.

In another aspect of the invention, the connecting of the first plate to the second frame comprises spot welding.

In another aspect of the invention, the connecting of the flange and the second frame comprises spot welding.

In another aspect of the invention, the apparatus comprises a glass substrate having lenses of acoustic emitters positioned thereon, a first frame positioned to support the glass substrate, a plate with apertures defined therein that are aligned with the lenses, a second frame positioned to support the plate, a first sealing member disposed between the plate and the second frame, a second sealing member disposed between the first frame and the second frame and a spacer positioned between the plate and the glass substrate, wherein the plate is connected to the second frame such that first sealing member is compressed, and further wherein the first frame is connected to the second frame such that the second sealing member is compressed and the glass substrate is maintained in a position between the first frame and the spacer and the plate whereby a focal gap is maintained between the glass substrate and the spacer.

In another aspect of the invention, the spacer has corrugations defined therein.

In another aspect of the invention, the apparatus comprises a spot weld to connect the first plate to the second frame.

In another aspect of the invention, the apparatus comprises a spot weld to connect the first frame to the second frame.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, in combination of the various parts of the device, and steps of the method, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

Figure 2:
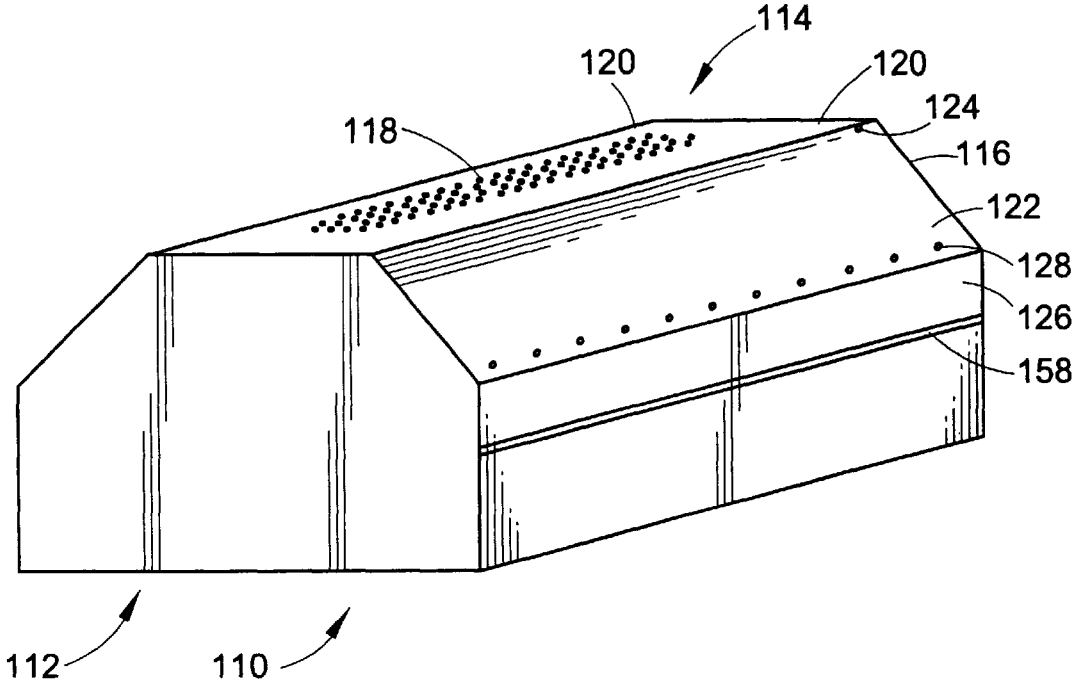
FIG. 2 is an illustration of a preferred embodiment of an acoustic fluid emitting head according to the present invention.

Referring back now to the drawings wherein the showings are for purposes of illustrating the preferred embodiments of the invention only and not for purposes of limiting same, FIG. 2 provides a view of the overall preferred apparatus according to the present invention. As shown in representative form, an acoustic fluid emission head, e.g. an acoustic ink printhead, 110 has a base portion 112 and an emitting portion 114. End portions of the head (one of which is shown in simplified form) may take a variety of forms as a function of the precise head configuration, which may vary.

The base portion 112 has included therein a variety of components well known to those versed in the field of acoustic fluid emission. For example, the base portion 112 may include electronics for controlling the operation of the head and fluid delivery components, e.g. manifolds, for facilitating proper delivery of fluid to the emitting portion of the head.

Figure 1:
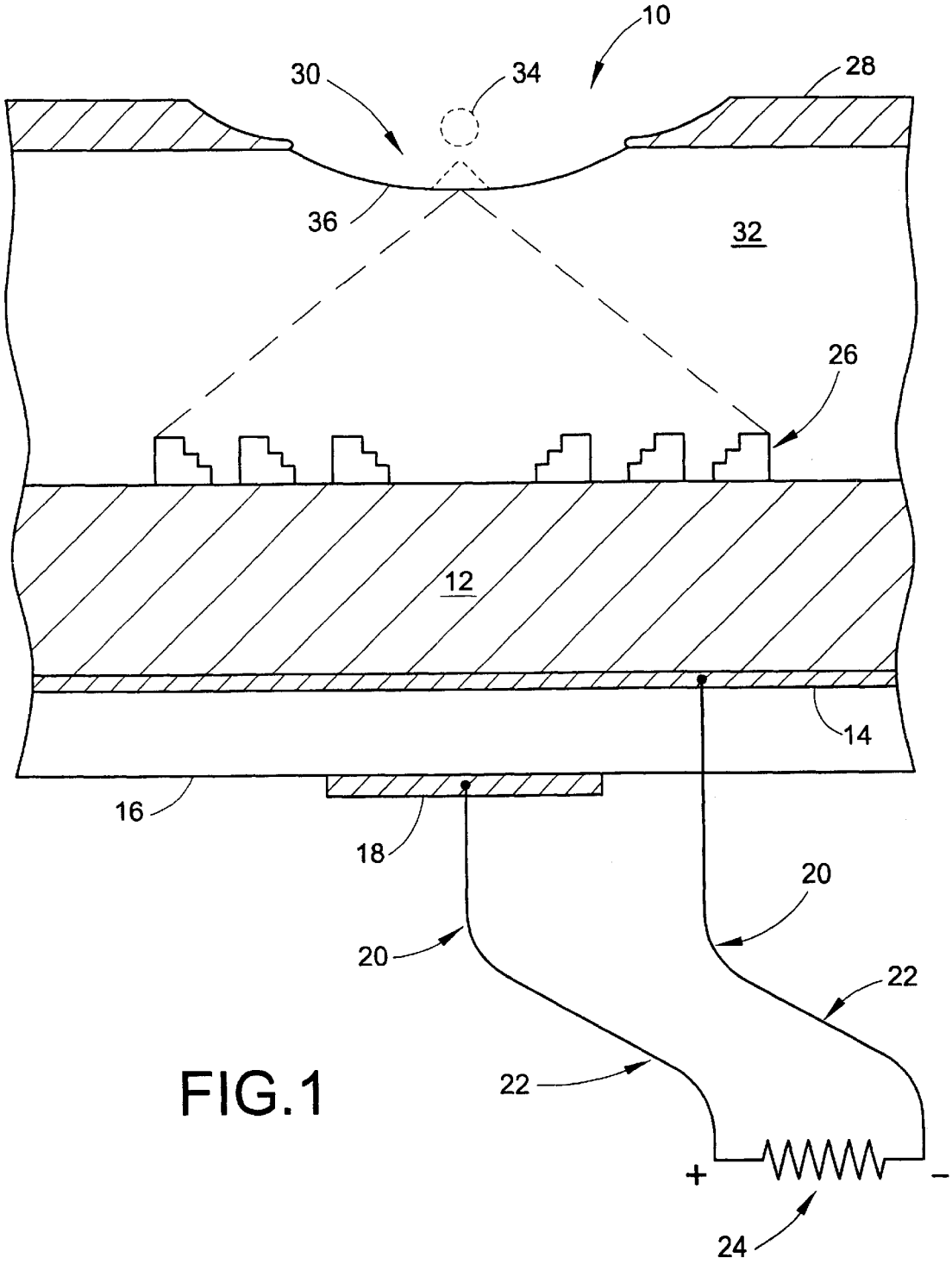
FIG. 1 is an illustration of an acoustic fluid emitting element.

The emitting portion 114 includes an aperture plate 116 disposed thereon. The plate 116 has a first portion 118 that has an aperture array positioned therein, second portions 120 adjacent the first portion, and a third portion 122 that is delineated from the second portion by a fold 124. It is to be appreciated that the apertures of the aperture array align with emitters having lenses as shown in, for example, FIG. 1.

Also shown in FIG. 2 is a frame 126 (preferably formed of metal) positioned to support the aperture plate 116. The frame 126 may take a variety of forms to achieve this objective as well as facilitate proper sealing of the printhead. The frame 126 preferably is disposed around the periphery of the printhead and, at its ends, generally conforms to the shape of the angled aperture plate, as will be apparent from the representative view shown in FIG. 2. It should be appreciated that the frame 126 may be unitary or may be comprised of a number of components suitably joined and/or scaled.

Significantly, the aperture plate 116 is connected to the frame 126 by connections representatively shown at 128. The connections are shown as being disposed along the bottom, generally straight edge of the aperture plate but it may be desirable in some circumstances to provide connections elsewhere, such as along the angled side edges of the plate. While the preferred form of the invention uses a plurality of spot welds as the connectors 128, as will be further described below, any suitable connection devices or techniques that accommodate the features of the present invention will suffice. For example, screws, pins or rivets could be suitably used in place of or in conjunction with the spot welds. It will be further appreciated by those skilled in the art that the left side of the head that is partially obscured in the figure includes components substantially identical to those shown on the right side that is in view.

Figure 3:
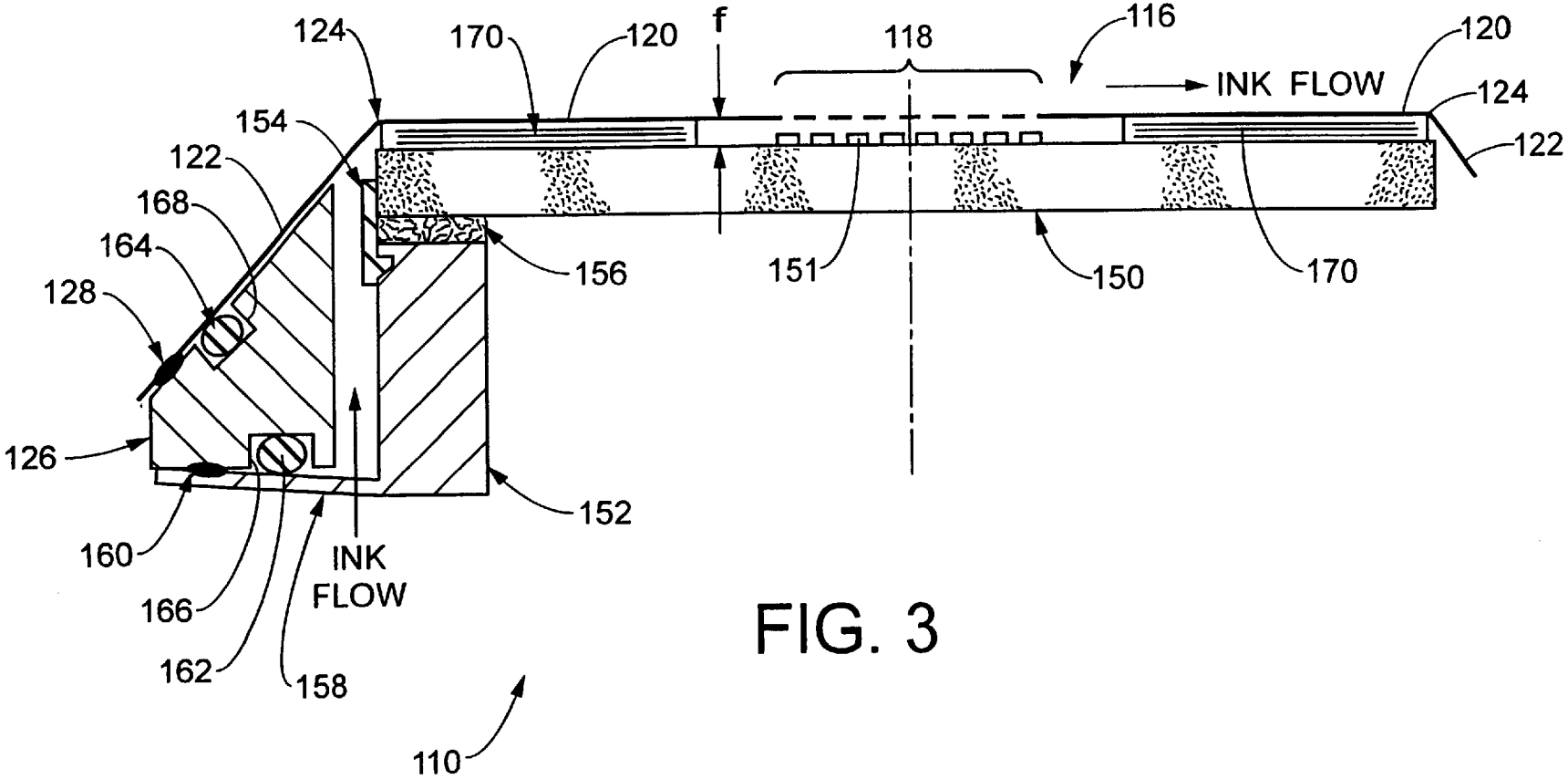
FIG. 3 is a cross-sectional view of a portion of the head of FIG. 2.

Referring now to FIG. 3 wherein a cross-sectional view of a portion of the head 110 is depicted, it will be seen that a glass substrate 150 is supported by a frame 152. The glass substrate 150 extends along the length of the printhead and has positioned thereon lenses, representatively shown at 151, aligned with the apertures of the aperture array of the first portion 118 of the plate 116. Of course, those of skill in the art will appreciate that, although not shown for simplicity, other elements of the acoustic emitters (such as those shown in FIG. 1—e.g. electrodes, piezoelectric layers, etc.) cooperate with the lenses and apertures to emit fluid from the device, as illustrated and described in connection with FIG. 1. In addition, it should be recognized that significant portions of the right side of the head as shown in FIG. 3 are not shown but are identical and complementary to those illustrated on the left side.

The frame 152, preferably formed of metal, may vary in configuration but, as described herein, extends around an inner periphery of the printhead and is sized and configured to support the substrate 150. For example, the frame 152 preferably is generally rectangular in shape. The frame 152 may be comprised of a unitary structure or a number of components suitably joined and/or sealed. The frame 152 has connected thereto tabs representatively shown at 154 that are suitably positioned to maintain the glass substrate 150 in position. These tabs may vary in number and location and may be connected to the frame 152 in a variety of known manners. A cushion and seal member 156 is also disposed between the glass layer 150 and the frame 152. The member 156 may take a variety of forms but preferably is formed of an elastomer or foam material and is disposed along the periphery or a top portion of the frame 152.

In addition, the frame 152 includes a flange portion 158 that extends along a bottom portion thereof to act as a deformable spring plate. The flange 158 is connected to the frame 126 via a connection 160. As with the connection represented at 128, the connections at 160 may take a variety of forms including but not limited to spot welds, screws, pins, or rivets.

A sealing member 162 is disposed between the flange 158 and the frame 126 around the circumference or periphery of the head. As such, the sealing member 162 lies generally in a single plane. In this regard, a recess 166 is preferably provided in the frame 126 to accommodate the sealing member 162.

In addition, a sealing member 164 is provided between the frame 126 and the third portions 122 of the plate 116 along the length of the head and substantially along the angled edge of plate 116. In this regard, the sealing member 164 is not disposed in a single plane but follows the shape of the plate 116, which is angled as shown in FIG. 2 and 3. Similarly, a recess 168 is provided to accommodate the sealing member 164.

It should be recognized that the sealing members 162 and 164 are preferably gaskets formed of an elastomer material. The gaskets may be shaped as o-rings or may be rectangular in form. In any configuration, the gaskets are preferably sized and configured to conform to the recess or desired shape to accomplish sealing. The recesses should be formed to suitably house these gaskets, maintain the position of the gaskets and allow for sufficient protrusion of the gaskets from the recesses to effect sealing. However, it should be appreciated that various sealing techniques could be used to attain the objectives of the invention, not all of which would require gaskets and/or recesses.

Further, a spacer plate, or spacer, 170 is provided between the plate 116 and the glass substrate 150 on both sides of the printhead. Preferably, spacer plates 170 are positioned between the second portions 120 of the plate 116 and portions of the glass substrate that do not have lenses formed thereon. The spacer plates 170 each preferably has corrugations defined therein. In this regard, a spacer plate 170 preferably is formed of 3×125 mil stainless steel ribbon and is corrugated to a dimension to provide a focal gap f between the first portion 118 of plate 116 and the glass substrate 150. The corrugations are aligned across the width of the head (left to right in FIG. 3) to accommodate the fluid flow indicated by the arrows in FIG. 3. Preferably, the corrugations provide about 75% transparency to minimize impedance to lateral fluid flow, and the fine pitch assures even fluid flow across the head. In addition, the spacer plate is preferably extremely stiff and experiences negligible compression under the force necessary to maintain the focal gap. Of course, it is to be recognized that the spacer may take a variety of forms provided that the spacer is of a configuration and positioned to maintain the focal gap f and fluid flow.

Figure 4:
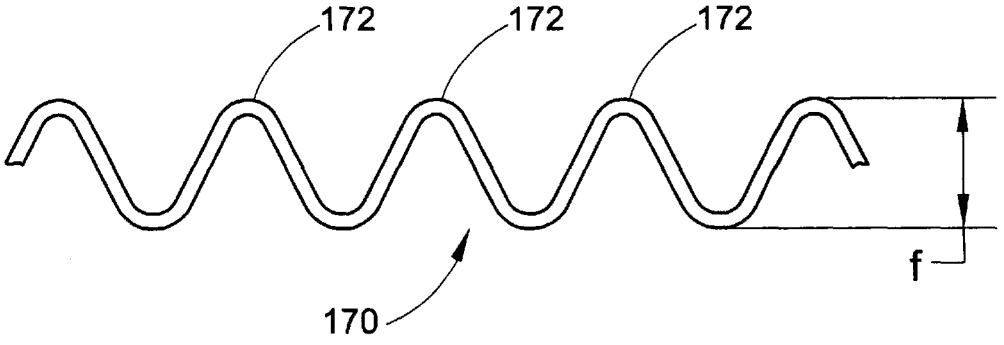
FIG. 4 is a side view of a portion of the spacer plate of FIG. 3.

Referring now to FIG. 4, a side view of a preferred spacer plate 170 is shown. The plate 170 has formed therein corrugations 172 that define an effective thickness of the plate 170 to substantially correspond to the focal gap f, also shown in FIG. 3. It should be appreciated that the corrugations 172 may be formed by any suitable techniques including those that are well known in the metal and wire bending field—provided that the resultant plate achieves the objectives of the invention.

To obtain the configuration shown in FIGS. 2–4, the aperture plate 116 (preferably approximately 100 micrometers thick) is first folded to approximately 55° (shown for example at 124 after connection) and spot welded to the frame 126 (shown for example at 128) near its outer edges. The frame 126 is beveled at approximately 45° and has the sealing member 164 positioned in the recess 168. The angle discrepancy between the fold of the plate 116 and the frame 126 gives the aperture plate 116 a downward bow to be counteracted by the upward force of the spacer plate(s) 170. Meanwhile, the glass substrate 150 containing the Fresnel lenses 151 and the elastomer cushion and seal member 156 are captured firmly by the tabs 154 of the frame 152. The bottom outer flange 158 of the frame 152 is preferably thin enough to deflect when the frame 152 and glass 150 are pressed up into the spacer(s) 170 and aperture plate 116. This ensures constant pressure against the spacer 170 over printhead life even if the cushion and seal member 156 takes a "set". The connection 160, e.g. a second set of spot welds which are suitably placed, substantially completes printhead assembly, with the exception of, for example, ink manifold and circuitry attachment. Ink entry and exit holes are not shown.

Figure 5:
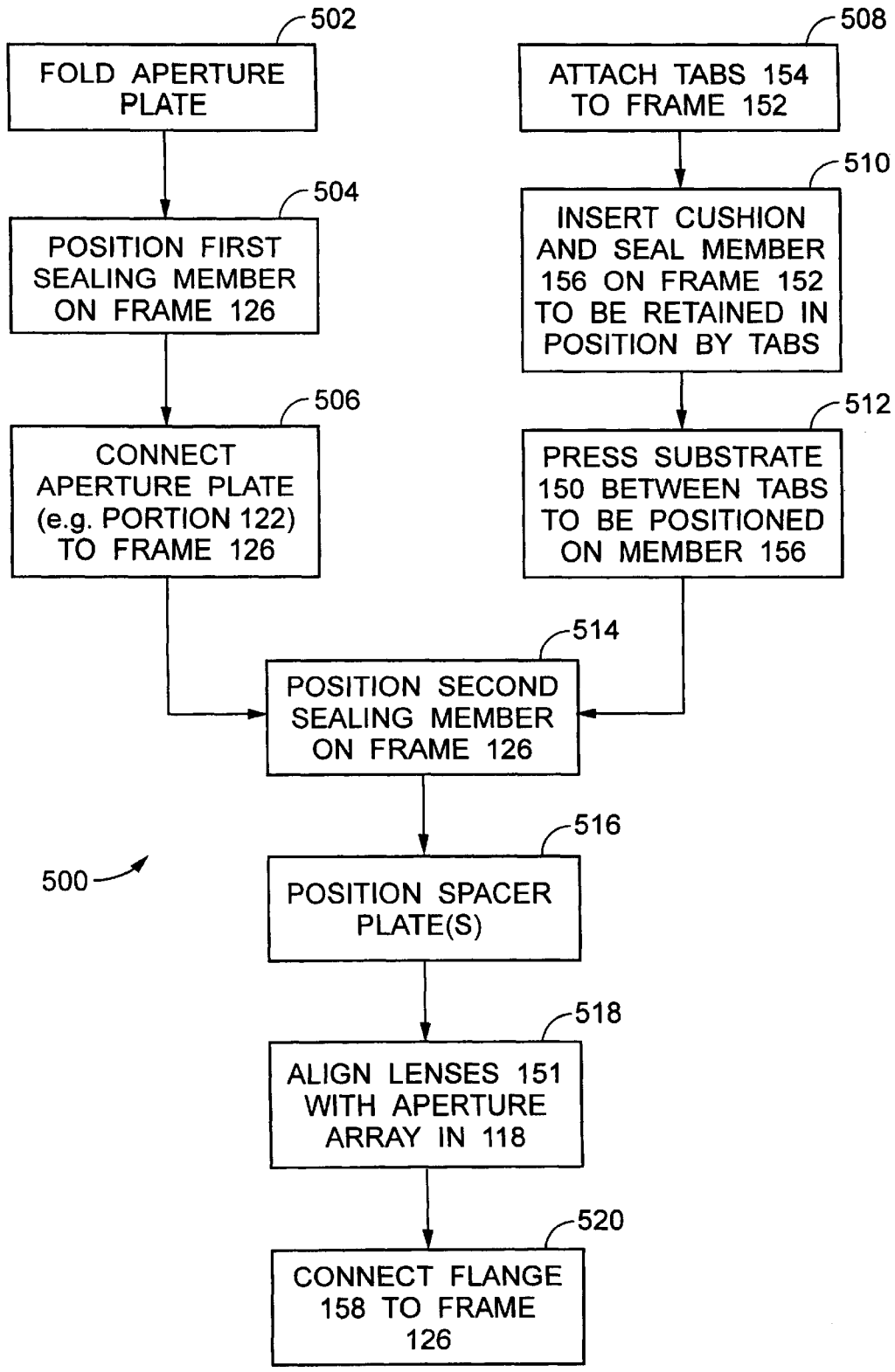
FIG. 5 is a flowchart illustrating a preferred assembly operation for the head shown in FIG. 2.

More specifically, referring now to FIG. 5, a method 500 of assembling the head 110 is illustrated in flowchart form. It is to be appreciated, however, that the particular order of the recited steps of this method may vary as a function of, for example, the preferences of the assembler or the equipment available in the assembly process. The steps themselves may also likewise vary. An important consideration in the assembly process, however, is that sufficient compression should be applied to the components of the head when it is being assembled so that, once the connections are made to complete assembly, the components maintain their position and the focal gap is maintained.

Initially, the plate 116 is folded such that a fold 124 demarcates the second portion 120 from the third portion 122 of the plate 116 on each side of the print head, of course (step 502). The sealing member 164 is advantageously positioned in the recess 168 of the frame 126 (step 504). The plate 116, i.e. portion 122, is connected to the frame 126 (on both sides of the plate/printhead) such that the first member 164 is compressed between the third portions 122 of the plate 116 and the frame 126 (step 506). The sealing member will also be compressed along the angled edge of the plate 116. Because of the differences in the angles of the fold and the bevel of the frame 126 as noted above, the third portions 122 of the plate will require a force to be applied to properly position the plate 116 for connection.

Steps 502–506 comprise the steps necessary to connect the aperture plate to the frame 126. Before final assembly of the printhead, it is also important (before, after or concurrently with the steps 502–506) to suitably position the glass substrate 150 on the frame 152. In this regard, the tabs 154 are positioned on, or attached to, the frame 152 at locations within the printhead that will facilitate retention of the glass substrate on the frame 152 (step 508). Next, the cushion and seal member 156 is positioned on the frame 152 to be retained in position by the tabs (step 510). The substrate 150 is then pressed into position on the member 156 and between the tabs (step 512).

Once the steps 502–506 and steps 508–512 are completed, the resultant combinations of components are ready for final assembly into the printhead. In this regard, a sealing member 162 is positioned in the recess 166 of the frame 126 in a plane around the periphery of the printhead and/or frame 126 (step 514). In this configuration, on each side of the printhead, a spacer plate 170 is positioned between a second portion of the first plate 116 and portions of the glass substrate 150 lacking lenses (step 516). The plate 116 is then positioned over the glass substrate 150 and the spacer plate(s) 170 such that the first portion 118 of the first plate 116 is aligned with the lenses of the emitters on the glass substrate 150 and such that a focal gap f is established therebetween (step 518). The flange portion 158 of the frame 152 is then connected to the frame 126 at appropriate locations around the printhead such that the sealing member 162 is compressed between the flange 158 and the frame (step 520). In this configuration, the flange portion will act as a spring plate and provide compression to the components of the head.

It is to be appreciated, as noted, that these steps may be accomplished in any suitable order but, preferably, the steps entail compressing the components of the printhead together bending the third portion of the plate into position for attachment and spot welding the components at locations such as 128 and 160 in order to maintain a suitable level of compression. The compressive forces maintained in the printhead generate suitable forces on the aperture plate 116 and, consequently the spacer plate, to maintain the focal gap.

Replacement of epoxy by elastomer seals has numerous advantages. 1) The delamination failure mode is eliminated. 2) Cure time is eliminated. 3) Elastomer lifetime projections are easily made by measuring their stiffness over time at elevated temperatures. 4) Several elastomers are reliable and chemically inert even at the higher temperatures of 150° C. required for phase-change inks, including silicone, Viton and Kalrez. 5) Spring-loaded focal gap should be more stable than that of present epoxy bonded printheads. 6) The requirement to match thermal expansion of the aperture plate and printhead frame to the glass is relaxed, because there are no glue joints to shear off during assembly. Since alignment of apertures to lenses is needed only at the fixed operating temperature of the printhead, it may be possible to make both the aperture plate and the frames from stainless steel, thereby eliminating corrosion of alloy 42 in ink.

The above description merely provides a disclosure of particular embodiments of the invention and is not intended for the purposes of limiting the same thereto. As such, the invention is not limited to only the above-described embodiments. Rather, it is recognized that one skilled in the art could conceive alternative embodiments that fall within the scope of the invention.

Having thus described the invention, I hereby claim:

1. An apparatus useful for emitting droplets of liquid from a surface of a pool of the liquid, the apparatus comprising:

a glass substrate having lenses of acoustic emitters positioned thereon;

a first frame positioned to support the glass substrate, the first frame having a flange extending therefrom;

a first plate having a first portion with apertures defined therein, a second portion and a third portion, the apertures being positioned in alignment with the lenses of the glass substrate and separated from the lenses by a predetermined distance to establish a focal gap;

a second frame positioned to support the first plate;

a first sealing member disposed between the first plate and the second frame;

a second sealing member disposed between the flange of the first frame and the second frame; and, a second plate positioned between the second portion of the first plate and the glass substrate, the second plate having corrugations defined therein;

wherein the third portion of the first plate is disposed at an angle relative to the first and second portions and is connected to the second frame, wherein the flange of the first frame is connected to the second frame such that the glass substrate is maintained in a position between the first frame and the first plate.

2. The apparatus as set forth in claim 1 further comprising an elastomer cushion and seal member positioned between the first frame and the glass substrate.

3. The apparatus as set forth in claim 1 wherein the flange is a deformable spring plate.

4. The apparatus as set forth in claim 1 further comprising a fold between the second and third portions of the first plate.

5. The apparatus as set forth in claim 1 wherein the first sealing member is an elastomer gasket.

6. The apparatus as set forth in claim 1 wherein the second sealing member is an elastomer gasket.

7. The apparatus as set forth in claim 5 wherein the second frame includes a recess into which the elastomer gasket is disposed.

8. The apparatus as set forth in claim 6 wherein the second frame includes a recess into which the elastomer gasket is disposed.

9. The apparatus as set forth in claim 1 wherein the corrugations of the second plate are disposed to facilitate fluid flow.

10. The apparatus as set forth in claim 1 further comprising a spot weld to connect the third portion of the first plate to the second frame.

11. The apparatus as set forth in claim 1 further comprising a spot weld to connect the flange of the first frame to the second frame.

12. The apparatus as set forth in claim 1 further comprising a fluid path extending between the first and second frames and through the corrugations of the second plate and the focal gap.

13. The apparatus as set forth in claim 1 further comprising a tab positioned to align the glass substrate on the first frame.

14. A method of forming an acoustic fluid emission head having a glass substrate having lenses of acoustic emitters positioned on a first portion thereof, a first frame, the first frame having a flange extending therefrom, a first plate having a first portion with apertures defined therein, a second portion and a third portion, a second frame having first and second recesses defined therein, a first sealing member, a second sealing member, and a second plate, the second plate having corrugations defined therein, the method comprising steps of:

folding the first plate such that a fold demarcates the second portion from the third portion;

positioning the first sealing member in the first recess of the second frame;

connecting the first plate to the second frame such that the first sealing member is compressed between the third portion of the first plate and the second frame;

positioning the glass substrate to be supported by the first frame;

maintaining the position of the glass substrate relative to the first frame with tabs extending from the first frame;

positioning the second sealing member in the second recess of the second frame;

positioning the second plate on a second portion of the glass substrate;

positioning the first plate over the glass substrate and the second plate such that the first portion of the first plate is in alignment with the first portion of the glass substrate, such that a focal gap is established between the first portion of the first plate and the first portion of the glass substrate, and such that the second plate is positioned between the second portion of the first plate and the second portion of the glass substrate; and, connecting the flange of the first frame to the second frame such that the second sealing member is compressed between the flange of the first frame and the second frame.

15. The method as set forth in claim 14 wherein the connecting of the first plate to the second frame comprises spot welding.

16. The method as set forth in claim 14 wherein the connecting of the flange and the second frame comprises spot welding.

17. An apparatus useful for emitting droplets of liquid from a surface of a pool of the liquid, the apparatus comprising:

a glass substrate having lenses of acoustic emitters positioned thereon;

a first frame positioned to support the glass substrate;

a plate with apertures defined therein that are aligned with the lenses;

a second frame positioned to support the plate;

a first sealing member disposed between the plate and the second frame;

a second sealing member disposed between the first frame and the second frame; and, a spacer positioned between the plate and the glass substrate;

wherein the plate is connected to the second frame such that first sealing member is compressed, wherein the first frame is connected to the second frame such that the second sealing member is compressed and the glass substrate is maintained in a position between the first frame and the spacer and the plate whereby a focal gap is maintained between the glass substrate and the plate.

18. The apparatus as set forth in claim 17 wherein the spacer has corrugations defined therein.

19. The apparatus as set forth in claim 17 further comprising a spot weld to connect the first plate to the second frame.

20. The apparatus as set forth in claim 17 further comprising a spot weld to connect the first frame to the second frame.

* * * * *